US005153412A

United States Patent [19]

Schreder

[11] Patent Number: 5,153,412

[45] Date of Patent: Oct. 6, 1992

[54] ELECTRIC HOTPLATE

[75] Inventor: Felix Schreder, Oberderdingen, Fed. Rep. of Germany

[73] Assignee: E.G.O. Elektro-Gerate Blanc u. Fischer, Fed. Rep. of Germany

[21] Appl. No.: 524,223

[22] Filed: May 15, 1990

[30] Foreign Application Priority Data

May 23, 1989 [DE] Fed. Rep. of Germany ..... 3916725

[51] Int. Cl.[5] ..... H05B 3/70

[52] U.S. Cl. ..... 219/451; 219/463

[58] Field of Search ..... 219/451, 463, 467, 457, 219/464, 459, 444, 458

[56] References Cited

U.S. PATENT DOCUMENTS

| | | | |
|---|---|---|---|
| 2,101,110 | 12/1937 | Thornton | 219/457 |
| 3,087,042 | 4/1963 | Hanson | 219/451 |
| 3,197,617 | 7/1965 | Gillespie | 219/451 |
| 4,766,290 | 8/1988 | Schreder | 219/458 |
| 4,871,902 | 10/1989 | Kicherer | 219/458 |
| 4,922,080 | 5/1990 | Kicherer | 219/457 |

FOREIGN PATENT DOCUMENTS

| | | |
|---|---|---|
| 0102015 | 3/1984 | European Pat. Off. . |
| 0167911 | 1/1986 | European Pat. Off. . |
| 0113923 | 9/1987 | European Pat. Off. . |
| 0307630 | 3/1989 | European Pat. Off. . |
| 7837478 | 3/1979 | Fed. Rep. of Germany . |
| 2933349 | 3/1981 | Fed. Rep. of Germany . |

*Primary Examiner*—Teresa J. Walberg
*Attorney, Agent, or Firm*—Quarles & Brady

[57] ABSTRACT

In an electric hotplate (1) flexible connecting leads (22), whose outer ends form connecting members (29) for connection to appliance lines, are so connected in positionally secured manner to short, bent pins (13) that the connection points or junctions (28) are directly accessible from the outside by welding tongs or the like for producing welded joints directly adjacent to an insulator (9). For the conection of these inner ends (25) to the pins (13) in such a way that they directly engage on the insulator (9), an orienting device (30) is provided as an auxiliary tool and can be oriented with a fork-like centering member (40) with respect to the insulator (9) and has orienting receptacles (42) for the engagement of end portions of the inner ends (25) of the leads (22).

25 Claims, 5 Drawing Sheets

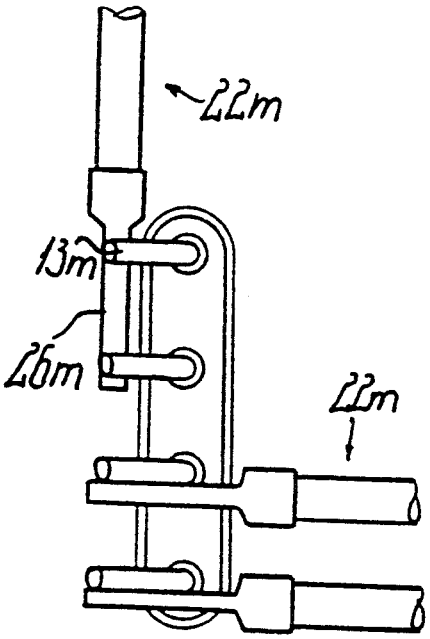
Fig. 16
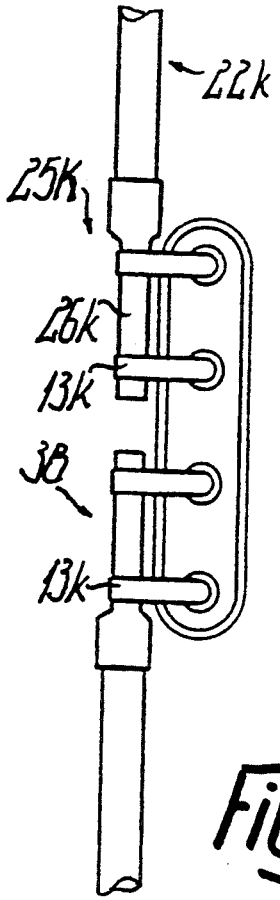
Fig. 15
Fig. 18
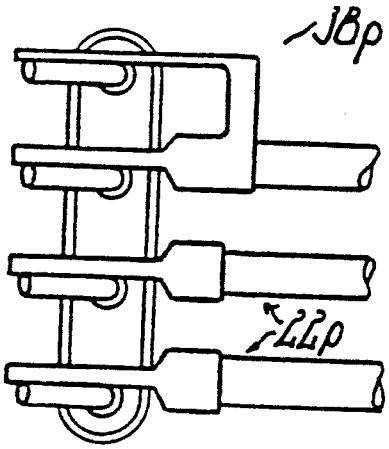
Fig. 17
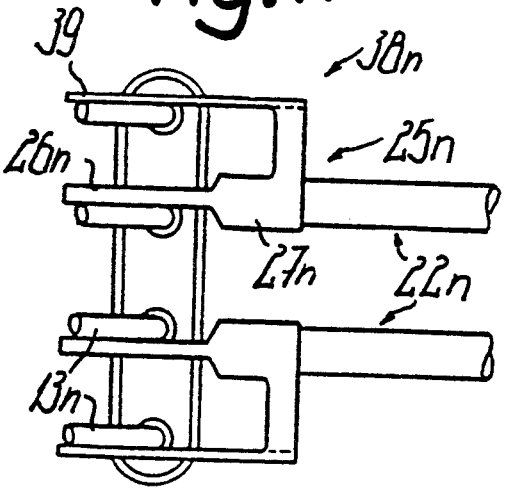

ELECTRIC HOTPLATE

BACKGROUND OF THE INVENTION

1. Field of the Invention

The invention relates to an electric hotplate with connecting members, which are provided for the electrical connection of the hotplate during installation in a hob or the like.

2. Prior Art

European patent application 102 015 discloses an electric hotplate with flexible connecting leads, which within an insulator located on the underside of the hotplate and serving for the passage of the leads through a lower covering are connected to the ends of bent connecting wires, which are connected with angle legs located within a substantially closed area of the hotplate to the heating resistor or resistors of the heating means. At the outer ends the leads are combined with a connecting piece made from insulating material and by means of which they project in the manner of pins with their connecting members. This construction is suitable for numerous applications, but the bending of the leads or a concealed connection thereof is not always desired.

DE-OS 29 33 349 discloses leads combined into a flexible strip, which pass through the insulator and whose inner ends are directly connected to pins, which project out of an embedding material receiving the heating resistors.

European patent application 113 923 discloses pin or rod-like connecting leads, which are connected in the vicinity of the outside of the insulator to short stubs of insulating wires and whose outer ends are positioned in the vicinity of an envelope surface defined by the outer circumference of the hotplate body, so that the connecting members formed by them are positioned relatively close to the electric hotplate.

SUMMARY OF THE INVENTION

An object of the invention is to provide an electric hotplate of the aforementioned type, in which the disadvantages of known constructions are avoided and which is particularly suitable for automated installation and which can be easily electrically connected both manually and optionally also in automated manner.

According to the invention this object is achieved in that following the substantially complete installation of the electric hotplate, e.g. after fixing the lower covering, ends of the pins accessible from the outside of the electric hotplate are connected to the inner ends of relatively long connecting leads, which in the area within the outer circumference or the associated envelope surface of the hotplate are substantially free from bends and whose portion projecting in the stretched state over the outer circumference are significantly longer than the portions within the outer circumference. For example the portions outside the circumference can be two to four times and in particular roughly three times longer than the portions within the outer circumference. The flexible or slightly bendable leads are advantageously given such a bending strength with respect to their length that they are just able to carry their own weight without any particular bending deformation, i.e. they can freely project parallel to one another in the manner of long connecting rods, but in the case of the action of limited forces on their outer ends can be deflected out of this position and can therefore be easily handled on connection. As a function of the length, the leads can be formed by strands assembled from a plurality of individual wires or by a single solid wire. They are appropriately made from a high temperature-resistant alloy, e.g. a nickel alloy or a chrome-nickel alloy. It is particularly appropriate for the leads to be uninterruptedly provided over their entire length with a high temperature-resistant insulation, e.g. a braided fibre glass insulation.

In place of this construction or in addition thereto, it is also proposed for solving an object of the invention, that the leads having resilience or recovery characteristics are so oriented in their position with respect to the electric hotplate that their inner ends over a length much greater than the diameter thereof are bending resistant or significantly more bending resistant than their main portions located between the ends and that said inner ends are so connected by the connection with the associated, corresponding bending resistant connecting wire, that the resulting connection or junction point is positionally secured in an almost clearance-free manner relative to the insulator. Thus, the inner ends of the leads are fixed relative to the hotplate in an almost positionally rigid manner on portions projecting over the outer circumference of the insulator and only the connecting main portion of the lead, which appropriately extends within the outer circumference of the hotplate is flexible or resiliently elastically bendable. The outer ends or the connecting members of the leads are preferably independently handlable of one another without reciprocal connection, but can also be combined in an insulator to form a common plug.

The described construction leads to an arrangement in which the inner end of each lead is stiffened with an e.g. sleeve-like stiffening member, which can surround the inner end of the member forming the main portion of the lead, namely the strand or solid wire and appropriately secures the associated end of the insulation. This metallic stiffening member is simultaneously used for the welded connection to the associated connecting wire, whose outer end it can cross in laterally engaging manner that the faces in contact with one another at the crossing point can be interconnected from the outside by welding. The weld is appropriately located just outside the insulator or an associated outer face of the insulator, so that on the one hand there is a good access for welding tongs and on the other the welded joint is so close to the insulator, that at least a portion of the inner end of the lead adjacent to the junction can be directly supported on the insulator for securing the position.

A particularly advantageous further development of the invention comprises the inner end of the lead engaging in a reception opening of the insulator in the manner of a plug connection for orientation or position securing purposes, the inner end having a position which differs from the coaxial position to the connecting wire or to an associated lead-through opening in the insulator in such a way that it is prevented from moving by engaging in said opening, because such movements would lead to a rotation about the central axis of the connecting wire portion positioned in the insulator. The reception opening could be an opening which is cross-sectionally substantially closed over the outer circumference and into which can be inserted the inner end of the lead in its longitudinal direction. However, the reception opening is preferably slot-like, so that the inner end of the lead can be inserted therein at right angles to its longitudinal direction. The boundaries of the reception opening and in particular its lateral faces, as well as the base face closer to the associated hotplate side are used for supporting the inner end of the lead, which can e.g. engage under the spring tension of the connecting wire with a limited pretension on the base face.

Another advantageous further development of the invention comprises the insulator having a bending edge for bending the outer end of the associated connecting wire and that said bending edge is appropriately set back at right angles to the inner end of the lead, so that also in the case of a small bending angle of less than 90° or 75° of the outer end of the connecting wire, there is a junction with the outer lead end directly adjacent to the outside of the insulator.

According to a further development of the invention a support or a stop is provided for the end face of the inner end of the lead, particularly on the insulator, so that in simple manner and without additional aids a precise longitudinal alignment of said inner end with respect to the hotplate can be obtained.

According to another inventive proposal the inner end of at least one lead is constructed as an electrical connection bridge for at least two pins formed by the outer ends of connecting wires, so that e.g. an electric hotplate constructed for operation with a seven-timing switch can be operated via a power control device or a sensor-controlled temperature regulator. The connection bridge can be constructed e.g. similar to that of German Utility Model 78 37 478 (corresponding to U.S. Pat. No. 4,303,295), to which reference should be made for further details and effects. However, the connection bridge can also be directly formed by said stiffening member in particular constructed as a multicore cable end, if it crosses the two associated pins and therefore can be connected directly thereto via the described cross welds.

The invention also relates to an apparatus for the installation of an electric hotplate. A further object of the invention is to create an apparatus of this type, which permits a simple orientation or alignment of the inner ends of the leads with respect to the pins or with respect to the insulator and the electric hotplate.

According to the invention this object is achieved by an orienting device, which is on the one hand constructed for oriented engagement in a countermember of the hotplate, particularly directly in the insulator and on the other hand has receptacles for the oriented engagement of the inner ends of the leads, so that simultaneously all the leads are fixed in oriented manner with respect to the pins and then the said welded joints can be produced. Appropriately the orienting device is constructed in such a way that it is only engaged by plug connections with the hotplate or the insulator and the inner ends of the leads. When the orienting device is in the working position, the pins and the inner ends of the leads are freely accessible to the welding tongs in the vicinity of their connection points.

BRIEF DESCRIPTION OF THE DRAWINGS

These and further features of preferred developments of the invention can be gathered from the claims, description and drawings and the individual features can be realized in an embodiment of the invention and in other fields either singly or in the form of sub-combinations and constitute advantageous, independently protectable constructions, for which protection is hereby claimed. The invention is described in greater hereinafter relative to the embodiments and the attached drawings, wherein are shown:

FIGS. 15 to 18: Further embodiments in representations corresponding to FIG. 2.

DETAILED DESCRIPTION OF THE PREFERRED EMBODIMENTS

Figure 1:
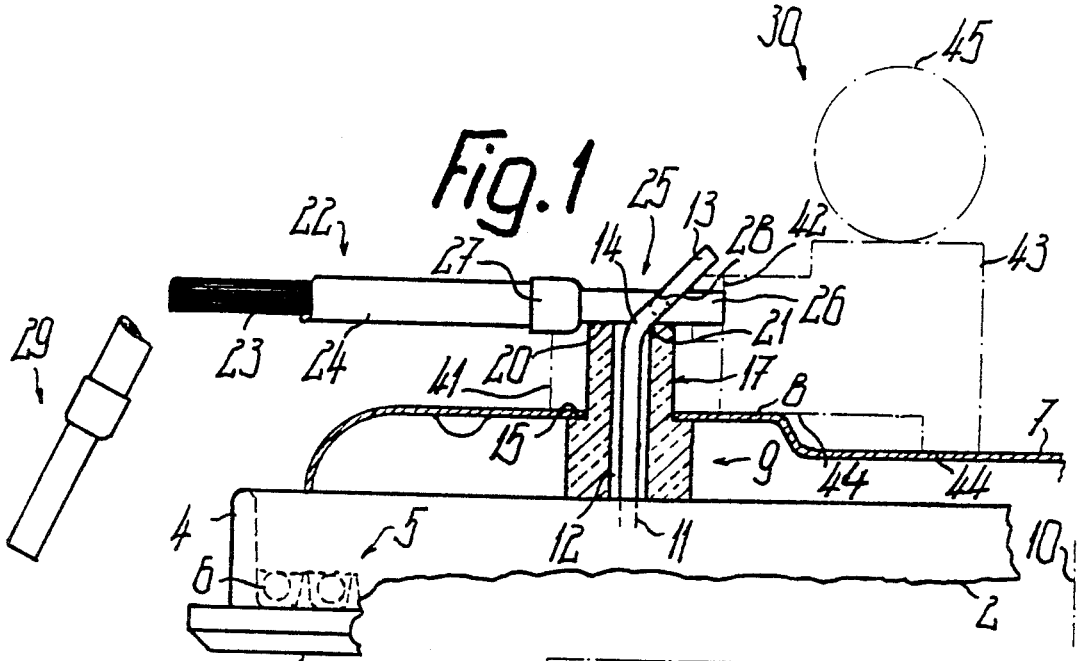
FIG. 1: A detail of an inventive hotplate in a part sectional representation and in the inverted position during installation.
Figure 2:
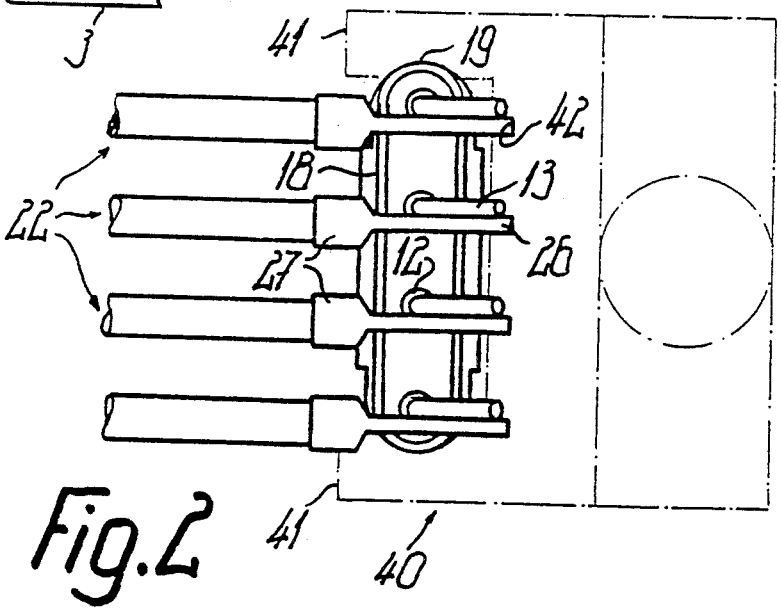
FIG. 2: A detail according to FIG. 1 in a view of the underside of the hotplate.
Figure 3:
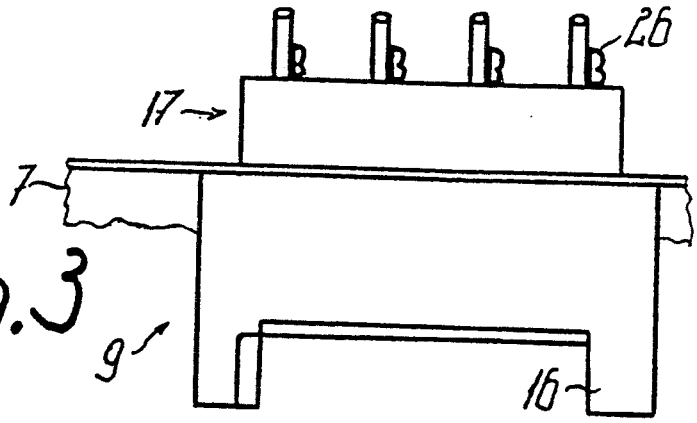
FIG. 3: A section through the arrangement according to FIG. 1.

The electric hotplate 1 according to FIGS. 1 to 3 has a hotplate body 2 with a substantially planar, closed cooking surface 3 on the top and an outer flange rim 4 on the bottom. Within the flange rim 4 is provided a heating means displaced towards the cooking surface 3 with respect to its lower front edge and which have one or more heating resistors 6 embedded in spiral grooves in a mouled insulating material. The space receiving the heating means 4 and defined on the outer circumference by flange rim 4 is closed on the underside of hotplate 1 by a covering 7 formed by a sheet metal cover and whose bottom part 8 substantially parallel to cooking surface 3 is exposed and whose edge engages in not shown manner in the hotplate body 2. A ceramic insulator 9 is inserted in a downwardly stamped out projection of bottom part 8 closer to the outer circumference of flange rim 4 than to a centre axis of hotplate 1 at right angles to the cooking surface 3 and indicated at 10 and through which connecting wires 11 for the heating means 5 are led out of the underside of hotplate 1.

In the represented embodiment there are four spaced, juxtaposed, connecting wires 11, which within the space receiving the heating means 5 in not shown manner are bent roughly parallel to the cooking surface 3 and electrically conductively connected to the heating resistors 6. The connecting wires 11 are in a common axial plane roughly parallel to an axial plane of the centre axis 10 and are juxtaposed in a row, each connecting wire 11 being led downwards out of the hotplate 1 through a separate, relatively closely adapted lead-through opening 12 of insulator 9. The portions of the connecting wires 11 located in the insulator 9 and roughly parallel to centre axis 10 are provided in the vicinity of their exit from the insulator 9 with in each case a bend 14, so that their end portions form short, parallel pins 13, which are bent away from the closest circumferential region of the hotplate 1 to them in the direction of the centre axis 10 and under an angle of approximately 45°. Pins 13 are shorter than the portions of connecting wires 11 aligned with the openings 12, so that they cannot be bent by manual forces or the weight forces of hotplate 1 and are instead relatively stiff elements, which are positionally rigid with respect to insulator 9.

A projecting shoulder 15 of insulator 9 engages on the inner face of bottom part 8 of covering 7 and can be supported with support legs 16 in the vicinity of heating means 5 on the underside of the hotplate body 2, the bent legs of the connecting wires 11 being guided between the legs 16 to the connecting points to the heating resistors 6. Insulator 9 traverses by an elongated outer portion 17 in a view parallel to openings 12 and projecting over the shoulder 50 through a passage opening closely adapted to said outer portion 17, so that the insulator 9 is precisely positionally secured solely by insertion from the inside of the covering 7 with respect to the hotplate body 2. Outer portion 17 forms longitudinal sides 18 and in the view according to FIG. 2 the pins 13 can project over the longitudinal side facing the centre axis 10. On the underside the outer portion 17 of insulator 9 forms an end face 20 at right angles to the lead-through openings 12 and traversed by the latter and which forms together with the end of each opening 12 a substantially angular shoulder edge 21, which can be used for support purposes during the bending of pins 13, so that the bends 14 are located in the vicinity of the end face 20.

To each of the four pins 13 is connected by its inner end 25 a lead 22 engaging freely over its entire length on the underside of hotplate 1, the inner ends 25 of all the leads being parallel to one another, juxtaposed and equidistant of the underside of hotplate 1 and optionally under a slight pretension so engage on a longitudinal side of the end face 20, that they project over both longitudinal sides 18 of insulator 9. The lead 22 has a current-carrying strand 23, which is envelope by a high temperature-resistant flexible or gaze-like, thin insulation 24. At each end strand 23 projects over insulation 24 and it is surrounded at the inner end 25 by a cross-sectionally clamp-like multicore cable end 26, which embraces with a dead-end binding 27 the associated end of insulation 24 and therefore brings about positional fixing with respect to strand 23.

The stiffened inner end 25 of each strand 23 formed by the multicore cable end 26 engages with a wider cross-sectional side laterally on one side of pin 13 by means of a longitudinal portion connected to bend 14 or enclosing the latter. As a result the inner end 25 and the pin 13 intersect under an angle of approximately 45 and are welded together at the crossing and contact point accompanied by the formation of a junction 28. The outer ends of the leads 22 can also be provided with stiffening members or multicore cable ends, which are constructed in the same or similar manner to those described hereinbefore and e.g. form plug pins, which are provided as connecting members 29 for the electrical connection of hotplate 1 to appliance lines.

For the connection of the inner ends to the pins 13 is provided an orienting device described in greater hereinafter enabling the parts to be connected to be precisely reciprocally oriented and positionally secured at least against movements parallel to a connecting line of the connecting wires 11.

In FIGS. 4 to 18 corresponding parts are given the same reference numerals as in the other drawings, but are accompanied by different letter references, so that the corresponding parts of the description apply for all the drawings.

Figure 4:
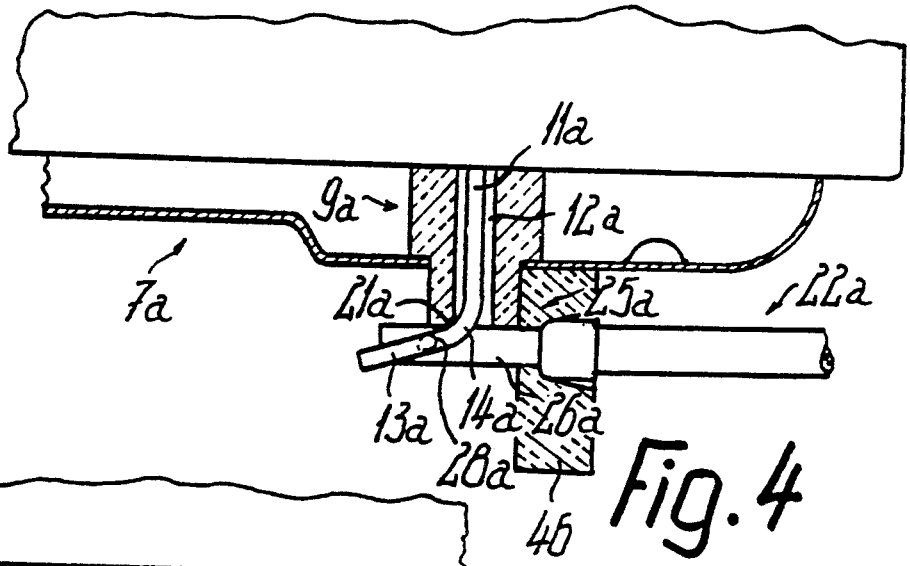
FIG. 4: Another embodiment in a detail corresponding to FIG. 1, but in the normal position.
Figure 5:
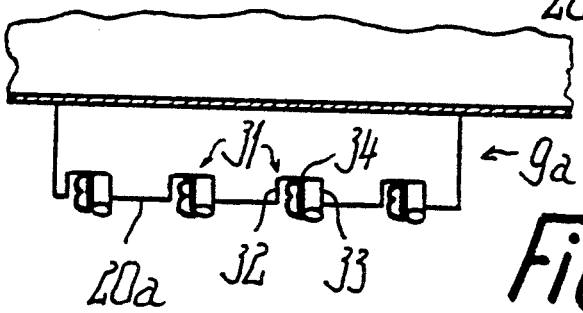
FIG. 5: A section through the arrangement according to FIG. 4.

In the embodiment according to FIGS. 4 and 5 in the vicinity of the end face 20*a* of insulator 9*a* reception opening 31 is provided for the pair formed by pin 13*a* and a multicore cable end 26*a* and said opening is preferably constructed as a cross slot open towards end face 20*a*. All the reception openings 31 are parallel to one another. In each case a lateral face 32 of each reception opening 31 is adjacent to the associated multicore cable end 26*a*, whilst the other lateral face 33 is adjacent to the associated pin 13*a*, so that the latter, including its bend 14*a*, bounds on one side a reception opening bounded on the other side by the insulator 9*a* for the insertion of the multicore cable end 26*a*. The depth of the reception openings 31 can be smaller than the cross-sectional extension of the multicore cable ends 26*a* to be measured in the same direction, so that they project with part of their cross-section over the end face 20*a*. The shoulder edge 21*a* belonging to bend 14*a* is in this case formed by the bottom surface 34 and is consequently set back with respect to the end face 20*a*, but can be downwardly displaced relative to the covering 7*a* or its lowest zone. In this embodiment pin 13*a* is bent more than the connecting wire 11*a*, namely by an angle of approximately 75, so that relative to the multicore cable end 26*a* it only forms a crossing angle of approximately 15. It is also conceivable to bend the pin 13*a* approximately parallel to the multicore cable end 26*a* or to choose a bend between 35 and 90. Through the engagement of the multicore cable ends 26*a* in the reception openings 32 and by the engagement thereof with longitudinal edges on the bottom surfaces 34, there is a good positional orientation during installation and a good and specifically positive securing of the position after installation. The connection or junction point 28*a* is once again located outside the boundary faces of insulator 9*a* or outside the reception openings 31.

Figure 6:
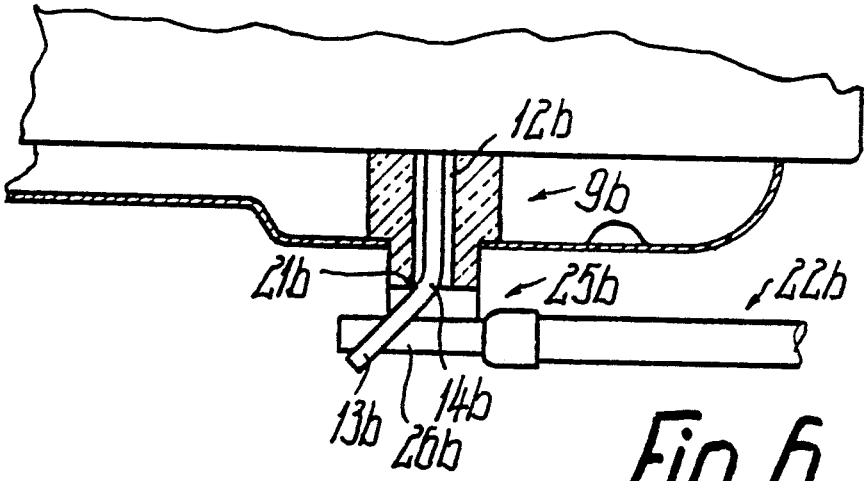
FIGS. 6 and 7: Another embodiment in representations corresponding to FIGS. 4 and 5.
Figure 7:
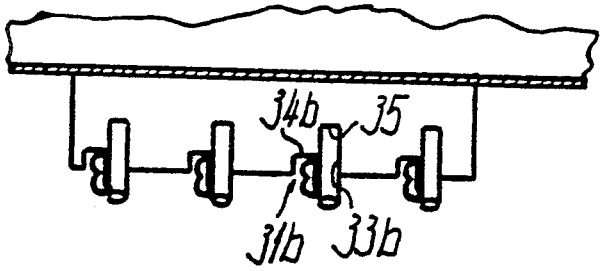

In the case of the embodiment of FIGS. 6 and 7, the bottom surface 34*b* of each reception opening 31*b* contains a slot-like depression 35 connected to the lateral face 33*b* and in which engages the pin 13*b* following on to its bend 14*b*, so that the shoulder edge 21*b* is displaced towards the underside of the hotplate relative to the support of the insulator 9*b* for the multicore cable end 26*b* formed by the bottom surface 34*b*. Thus, the multicore cable end 26*b* intersects the pin 13*b* at a limited distance from bend 14*b*.

Figure 8:
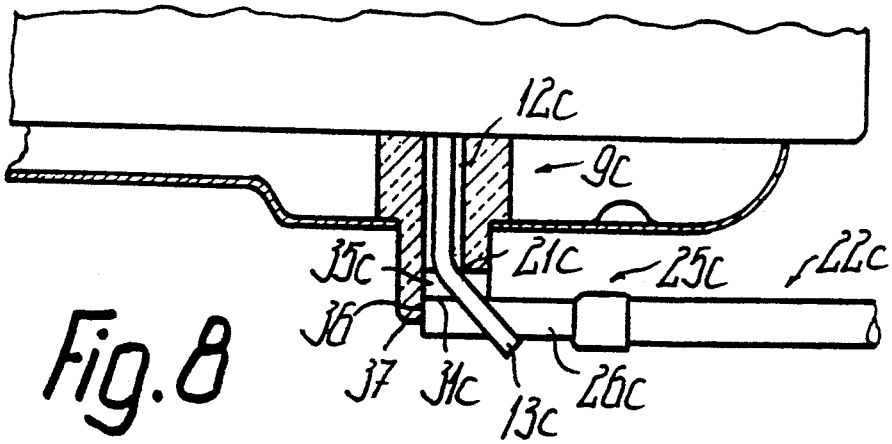
FIG. 8: Another embodiment in a representation according to FIG. 4.

In the embodiment according to FIG. 8 the free ends of the multicore cable ends 26*c* do not project over the associated longitudinal side of insulator 9*c* and instead their end faces engage on a stop 36 of insulator 9*c*, whose stop face can e.g. be aligned with the associated boundary of the lead-through opening 12*c*. For forming a common stop face for all the multicore cable ends 26*c*, the insulator 9*c* has a web 37 projecting along one longitudinal side over its outer end face and over whose longitudinal edge can project by part of the associated cross-section, the multicore cable ends 26*c*. Whereas in the embodiment according to FIG. 8 depressions 35*c* are provided for receiving the bends of the pins 13*c* and reception openings 31*c* for the multicore cable ends 26*c*, in the embodiment according to FIGS. 9 and 10 the multicore cable ends 26*d* engage on the end face 20*d* of insulator 9*d*, stops 36*d* or web 37*d* projecting over said end face 20*d*.

Figure 9:
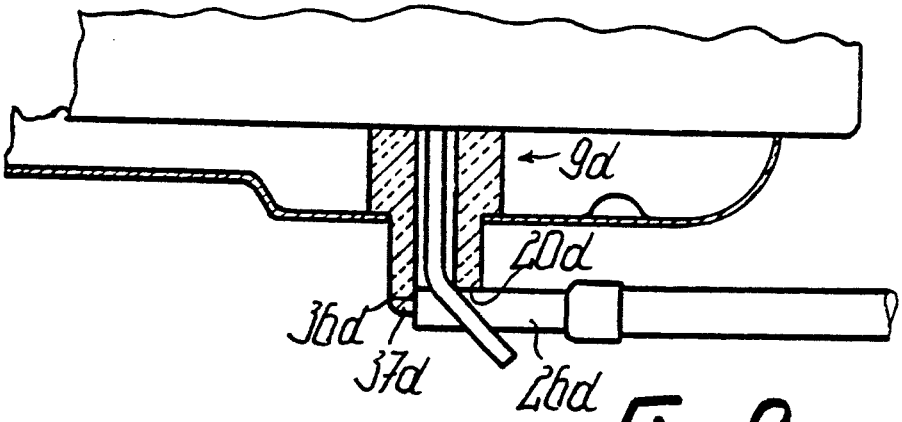
FIGS. 9 and 10: Another embodiment in representations according to FIGS. 4 and 5.
Figure 10:
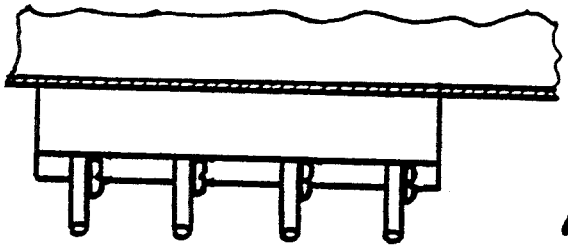

In the embodiments of FIGS. 8 to 10 the pins 13*c* are bent in the direction of the closest adjacent area of the outer circumference of the hotplate or away from the centre thereof.

Figure 11:
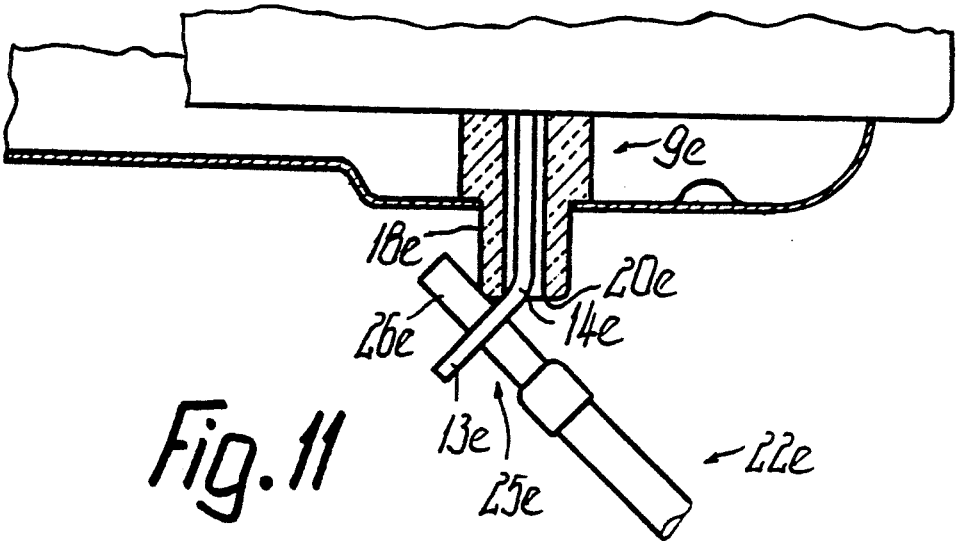
FIGS. 11 and 12: Two further embodiments in representations according to FIG. 4.

In the embodiment according to FIG. 11 the inner end 25*e* of the lead 22*e* is under an angle inclined to the underside or to the cooking surface of the hotplate, so that its distance from the plane of said underside increases towards its outer end. The multicore cable end 26*e* crosses the pin 13*e* under an angle of approximately 90 and instead of engaging in linear form as in the previous embodiments, engages in punctiform manner on one edge of insulator 9*e*, which is formed by the end face 20*e* and a lateral face 18*e*.

Figure 12:
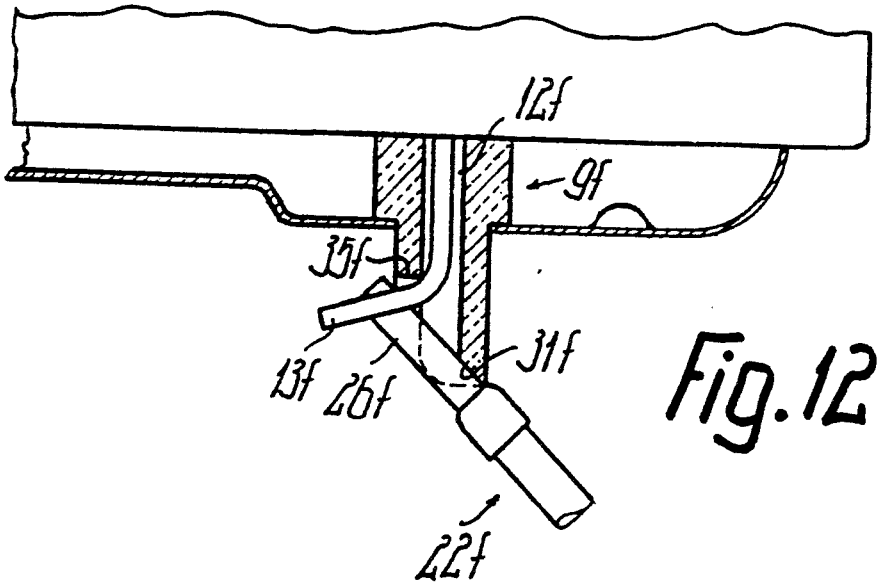

There is a corresponding positioning of lead 22*f* in the case of the embodiment according to FIG. 12, but the insulator 9*f* is provided in its outer end with a correspondingly sloping reception opening 31*f* for the multicore cable end 26*f* which slopes by approximately 45° to the cooking surface. A depression 35*f* is provided in the bottom of the reception opening 31*f* exclusively on that side of the lead-through openings 12*f* towards which the pins 13*f* are bent and forms the shoulder edge for bending pin 13*f*. The connection point between pin 13*f* and the multicore cable end 26*f* is immediately adjacent to the associated longitudinal side of connecting piece 9*f*.

Figure 13:
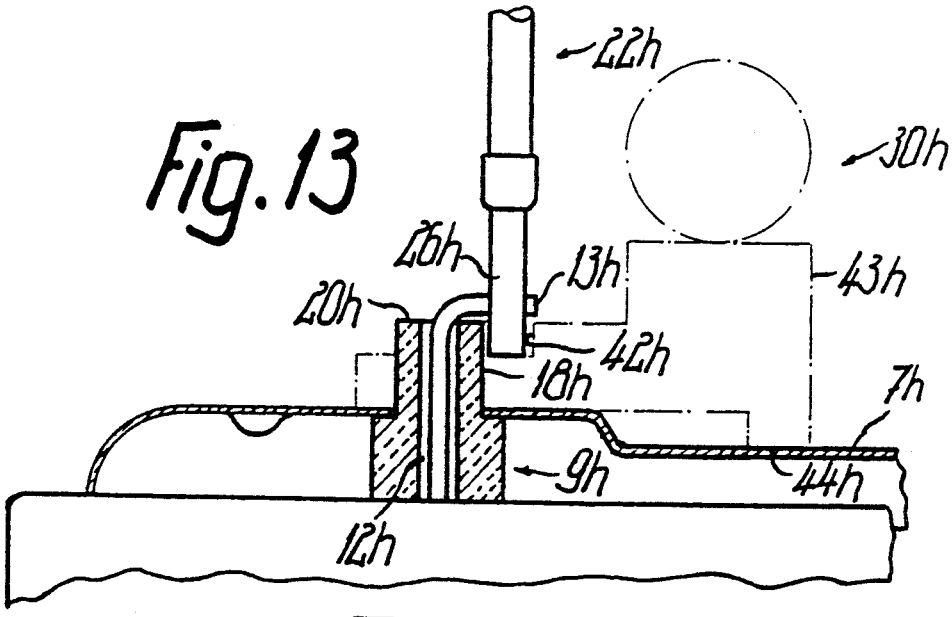
FIGS. 13 and 14: Another embodiment in representations according to FIGS. 1 and 2.
Figure 14:
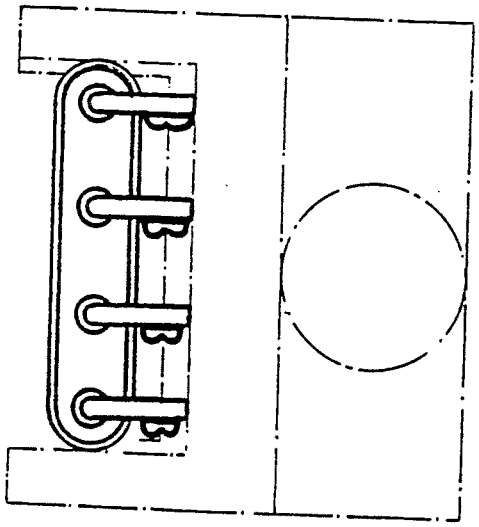

In the embodiment according to FIGS. 13 and 14 the pins 13*h* are bent roughly at right angles and the multicore cable ends 26*h* of leads 22*h* forming the inner ends are approximately at right angles to the cooking surface and are directed counter to the underside of the hotplate immediately adjacent to a longitudinal side of connecting piece 19*h*. Thus, the multicore cable ends 26*h* are substantially parallel to the lead-through openings 12*h*, but are laterally displaced with respect thereto and are prevented from moving by the end face 20*h* over which engages pin 13*h* and the longitudinal side 18*h* of the connecting piece 9*h* over which engages the multicore cable end 26*h*.

In the embodiment according to FIG. 15 two multicore cable ends 26*k* of two leads 22*k* form a connection bridge 38 for two adjacent pins 13*k*, in such a way that the particular multicore cable end 26*k* is located along a connection line between the two associated connecting pins 13*k*. As a result the two multicore cable ends 26*k* are aligned with one another and are appropriately fixed on the leg insides of pins 13*k* associated with the insides of the bends, so that they are positioned between said pins 13*k* and the underside of the hotplate.

In the embodiment according to FIG. 16 there are only two adjacent pins 13*m* which are interconnected by a multicore cable end 26*m*, whereas the other two pins are connected in one of the described ways to separate leads 22*m*, so that, in a view of the underside of the hotplate, there are leads 29*m* at right angles to one another.

As shown in FIG. 17, for the formation of a connection bridge 38*n*, the component forming the multicore cable end 26*n* can also be provided with an additional connecting lug 39, which is appropriately constructed in one piece with the multicore cable end 26*n* and is connected by means of a leg led away at right angles from the end collar 27*n* to the multicore cable end. The connecting lug 39 which is appropriately positioned parallel alongside the associated multicore cable end 26*n* is advantageously bent in such a way that it engages with one flat side on the associated pin or that its flat cross-section is roughly parallel to the flat cross-section of the multicore cable end 26*n*. According to FIG. 17 there are two homologously constructed connection bridges 38*n*, so that the leads 22*n* are immediately adjacent to one another, whilst the two connecting lugs 39 are connected to the two outer pins. According to FIG. 18 there is only one connection bridge 38*p*, whereas the two other leads 22*p* are separately connected, but all three leads are parallel and juxtaposed.

As can be gathered from FIGS. 1 and 2, the orienting or aligning device 30 can essentially be formed by a one-piece, e.g. heat-resistant, ceramic material body, which has a fork-like centring member 40 adapted to the outer portion 17 of insulator 9 and whose fork arms 41 in the working position of insulator 9, below the cover 7 embrace both end faces 19 and engage on the underside of bottom part 8 of covering 9. During installation the hotplate 1 is appropriately so inverted that its underside is at the top. In the bottom of the fork opening there are slot-like orienting receptacles 42 adapted to the shape and position of the multicore cable ends 26 and in which the latter can be inserted both in and at right angles to their longitudinal direction by movement towards the underside of the hotplate 1, so that they abutt-fixed by their end faces to the bottom faces of the orienting receptacles 42 and engage on the end face 20 of insulator 9. The depth of the orienting receptacle 42 is made relatively small, so that the multicore cable ends 26 are exposed between the fork arms 41 for producing the connection points 28. The basic member 43 forming the centring member 40 and the orienting receptacles 42 has stepped engagement faces for engagement on the underside of covering 7 and is provided on its side remote from the engagement surfaces 44 with a handle 45. The centring member 40 can be engaged with the insulator 9 at right angles to the underside of the hotplate and/or parallel thereto. After producing the joints 28, the orienting device can be removed in the opposite direction and then reused during the installation of a further hotplate.

In the embodiment according to FIGS. 13 and 14 the orienting receptacles 42 of the orienting device 30*h* are positioned adjacent to the fork opening or to its bottom face in the form of angularly defined depressions on the side of the basic body 43*h* remote from the engagement faces 44*h* or the covering 7*h*, so that in the working position their open sides at right angles to pins 13*h* are substantially closed by insulator 9*h*, so that the receptacles 42*h* are also bounded by the associated longitudinal side 18*h* of insulator 9*h*. Thus, the multicore cable ends 26*h* can be inserted in the orienting receptacles 42*h* until they engage on the bottom surfaces in such a way that they engage on the longitudinal side 18*h*.

In the case of the represented embodiments all the inner ends of the leads are connected substantially identically or in the same position with the associated pins. It is also conceivable to connect the inner ends of the leads differently or in a different position or to bend the pins in a different manner and random combinations of the represented and described embodiments are also possible. For example, advantageously pins can be bent in alternating, differing or opposite manner. Thus, e.g. in orientations according to FIG. 15, separate multicore cable ends for at least two pins can be located substantially on remote sides of the insulator. In a preferred embodiment, on both longitudinal sides of the insulator, there are two approximately aligned, oppositely directed multicore cable ends, whose leads are led away in opposite directions and each pin is connected to a separate multicore cable end.

The multicore cable ends are appropriately made from a high-quality or high temperature-resistant material, e.g. a nickel or a chrome-nickel alloy. A particularly advantageous construction is obtained if, according to FIG. 4, means are provided which in the immediate vicinity of the insulator 9*a* or the connecting wires 11*a*, the pins 13*a* and the inner ends 25*a* or the multicore cable ends 26*a* of leads 22*a* ensure that bare, current-carrying parts formed by these components cannot be contacted through components positioned below them, whereby the latter can e.g. be constituted by a lower end plate of a hob, a separate end plate fixed to the underside of the hotplate for encapsulating the connection area, electric conductors for further hotplates, etc. For spacing purposes there is at least one and in particular a single spacer and which e.g. in a construction according to FIGS. 8 and 9 could be formed by the insulator, but is preferably formed by a separate component, which can be supported with respect to the hotplate, namely e.g. on the underside of the covering 7*a* and laterally relative to the insulator 9*a* and projects downwards over all the bare, current-carrying components of the connection area. If this spacing component is in contact with current-carrying parts, then it is appropriately not made from metal, but from an insulating material, particularly a hard ceramic material.

Two or more or all the inner ends 25*a* or multicore cable ends 26*a* of the leads 22*a* associated with the hotplate can also be positionally fixed in reciprocally oriented form prior to the connection to the hotplate by using appropriate means and it is preferable to provide an elongated, ledge-like insulating holder 26, which is to be positioned on one longitudinal side of insulator 9*a*. For the reception of the particular multicore cable end 26*a*, the insulating holder 46 appropriately has a through-bore with a stepped inside width and in whose widened bore portion is so inserted the widened collar of the multicore cable end 26*a* receiving the insulation of lead 22*a*, that it is substantially completed located within the holder 46. For forming the connection points or junctions 28*a*, the multicore cable ends 26*a* project over the corresponding lateral face of the insulating holder 46.

Appropriately means are provided for fixing the inner end 25*a* or the multicore cable end 26*a* in clearance-free manner or with a tight fit with respect to the insulating holder 46. For this purpose the multicore cable end 26*a* can have e.g. in the vicinity of its widened collar one or more circumferential cams, spring tongues, etc., which when the inner end 25*a* thereof is inserted in the holder 46 are braced or claw-fastened with respect thereto. The through-bore, particularly the widened bore portion can be conically constricted in the insertion direction for the multicore cable end 26*a*, so that as a result the desired tight fit is obtained. A particularly advantageous further development of the invention comprises the insulating holder 46 simultaneously forming said spacing means, so that the same component fulfils both these functions.

The insulating holder 46 can be a simple, ledge-like component with approximately rectangular cross-sections. For example, in the case of a cross-sectionally angular construction, it can also have a leg, which engages over in a substantially complete and narrowly spaced manner the inner ends 25*a* or multicore cable ends 26*a* and pins 13*a* on the underside or on the side remote from insulator 9*a* in the form of a shield, so that said current-carrying parts are no longer accessible from below. In the construction according to FIG. 4 this e.g. also cross-sectionally rectangular leg would be connected to that side of the insulating holder 46 in right-angled manner which faces the junction 28*a*. Its construction would be such that the necessary accessibility for producing the junctions 28*a* would still exist, which can e.g. be ensured by welding tong access holes in said shielding part, or in that the latter has an adequately large spacing from those areas in which the junctions 28*a* are to be produced.

I claim:

1. An electric hotplate comprising:

heating means;

at least one connecting member for an electrical connection of the hotplate to at least one appliance line and provided on an outer end of a connecting lead connected with an inner end to an associated connecting wire of said hotplate, said inner end of said connecting lead being connected to said at least one connecting wire, wherein said inner end of said connecting lead is constructed as an electric bridge for a connection of at least two adjacent connecting wires.

2. An electric hotplate defining an outside and comprising:

heating means;

at least one connecting member for an electrical connection of the hotplate to at least one appliance line and provided on an outer end of an at least partly flexible connecting lead providing a mounting unit with said hotplate and connected with an inner end to an associated connecting wire of said hotplate, wherein said inner end of at least one connecting lead is connected to at least one pin substantially accessible on said outside of the hotplate and being formed by a connecting wire, said inner end of at least one of said at least one connecting lead being positionally secured substantially by an insulator, said inner end of at least one connecting lead being constructed as an electric bridge for a connection of at least two adjacent pins.

3. An electric hotplate defining an outside and comprising:

heating means;

at least one connecting member for an electrical connection of the hotplate to at least one appliance line and provided on an outer end of a connecting lead, said connecting lead providing a preassembled mounting unit with said hotplate and connected with an inner end to at least one associated connecting wire of said hotplate, an insulator receiving at least one pin being provided on said hotplate, said at least one connecting wire engaging said insulator and projecting to said outside for engagement with said at least one pin, said pin and said inner end being connected at an intermediate welding junction positionally securing said inner end close to said insulator, wherein means are provided for securing said inner end in an aligned orientation with respect to said insulator by direct interengagement between said inner end and said insulator.

4. The electric hotplate according to claim 3, wherein said at least one pin is bent with respect to at least one of definition references provided by a connecting portion of said connecting wire, a lead-through opening provided in said insulator for receiving said connecting wire and a center axis of said hotplate and said direct interengagement of said inner end and said insulator providing at least one of characteristics defined by a spring tensioned interengagement and a positive plug-in interengagement.

5. The electric hotplate according to claim 4, wherein said at least one pin provides a bend located in the vicinity of an outer shoulder edge of said lead-through opening.

6. The electric hotplate according to claim 3, wherein said at least one pin is bent towards a center of said hotplate.

7. The electric hotplate according to claim 3, wherein said at least one pin is bent by an angle of the bend of between 35° and 90°.

8. The electric hotplate according to claim 3, wherein said inner end of at least one connecting lead intersects said at least one pin under an angle between approximately 15° and 90°.

9. The electric hotplate according to claim 3, wherein said inner end of at least one connecting lead is inherently rigid and is formed by a multicore cable end casing shell enveloping a cable core of said lead, said welding junction being provided between a lateral face of said casing shell and said at least one pin.

10. The electric hotplate according to claim 9, wherein said casing shell end is made from high temperature-resistant material.

11. The electric hotplate according to claim 3, wherein said inner end of at least one connecting lead is fixed to said at least one connecting wire close to at least one of configurations provided by a lead-through opening in said insulator for penetratingly receiving said associated connecting wire and a bend of said at least one pin.

12. The electric hotplate according to claim 3, wherein said junction between said inner end and said at least one pin is laterally displaced with respect to a lead-through opening receiving said associated connecting wire.

13. The electric hotplate according to claim 3, wherein said securing means is provided by said inner end of at least one connecting lead being directly supported with respect to said insulator, said insulator having at least one supporting face apart from at least one lead-through opening for said associated connecting wire, at least one of arrangements defined by a spring tensioned engagement between said supporting face and said inner end and by a plug-in reception of said inner end in a reception opening of said insulator being provided, said securing means preventing rotation of said inner end about a longitudinal axis defined by a section of said connecting wire passing said lead-through opening.

14. The electric hotplate according to claim 13, wherein said insulator has a stop for an end face of said inner end of at least one connecting lead.

15. The electric hotplate according to claim 14, wherein a common stop formed by a stop web and passing over all of a number of inner ends of a number of connecting leads is provided, said inner ends being individually aligned with respect to said insulator.

16. The electric hotplate according to claim 14 or 15, wherein said stop provides a stop face, said pin being bent in at least one of directions defined by a direction away from said stop face and a direction towards an adjacent area of an outer circumference of said hotplate.

17. The electric hotplate according to claim 13, wherein a number of freely displaceable connecting leads is free of any interconnection except an aligned interconnection provided by said interengagement with said insulator, projecting through a bottom cover of said hotplate and traversed by a corresponding number of said connecting wires.

18. The electric hotplate according to claim 3, wherein said securing means is provided by said inner end of at least one connecting lead aligningly engaging in a reception opening adjacent to a lead-through opening of said insulator, said reception opening being bounded partially on one lateral side by said pin and on an opposite lateral side by said insulator.

19. The electric hotplate according to claim 18, wherein said reception opening has a bottom surface formed by the insulator and providing a support receiving a longitudinal edge of said inner end.

20. The electric hotplate according to claim 3, wherein at least one reception opening provided in said insulator for aligningly receiving said inner end of at least one connecting lead is provided with a boundary on a side closest to an underside of said hotplate, said boundary being at least partly located between a shoulder edge and an outer end face of said insulator.

21. The electric hotplate according to claim 20, wherein said boundary is provided by a groove oriented relative to a lead-through opening at an angle between 90° and substantially below 45°.

22. The electric hotplate according to claim 3, wherein said at least one connecting lead is located on an outside of the hotplate and below a cooking surface provides a longitudinal flexible section extending below a cooking surface of said hotplate and externally beyond an outer circumference of said hotplate in a straightened condition, said at least one connecting lead having a bending stability with respect to the overall length of a freely projecting longitudinal motion section so as to be substantially capable of only resisting a force defined by the weight of said motion section but bending upon an additional bending force above said weight.

23. The electric hotplate according to claim 3, wherein said at least one connecting lead is connected to said connecting wire in the vicinity of an underside of said hotplate formed by a lower covering and bearing said insulator.

24. An electric hotplate according to claim 3, wherein at least one spacer projecting downwardly over said connecting wire and said inner end of at least one connecting lead, is provided proximate to said inner end, said spacer receiving said inner end of said at least one connecting lead with tension substantially free of motion play.

25. The electric hotplate according to claim 24, wherein said at least one spacer is constructed as an insulating holder receiving in a preassembled state a number of inner ends, said insulating holder having constricted bores for receiving each of said inner ends axially secured and aligned by a direct tight fit engagement of said inner ends.

* * * * *